US006471119B2

(12) United States Patent
Cai

(10) Patent No.: US 6,471,119 B2
(45) Date of Patent: Oct. 29, 2002

(54) FOOD SCOOP WITH CONDIMENT HOLDER

(75) Inventor: Liming Cai, West Chester, PA (US)

(73) Assignee: Dopaco, Inc., Exton, PA (US)

( * ) Notice: Subject to any disclaimer, the term of this patent is extended or adjusted under 35 U.S.C. 154(b) by 0 days.

(21) Appl. No.: 09/795,136

(22) Filed: Mar. 1, 2001

(65) Prior Publication Data

US 2001/0035454 A1 Nov. 1, 2001

Related U.S. Application Data

(60) Provisional application No. 60/186,212, filed on Mar. 1, 2000.

(51) Int. Cl.[7] ..... B65P 5/36; B65P 5/487

(52) U.S. Cl. ..... 229/116; 229/120.12; 229/120.13; 229/120.18; 229/405; 229/906

(58) Field of Search ..... 229/4.5, 116, 117.01, 229/120.12, 120.13, 120.18, 400, 405, 902, 904, 906

(56) References Cited

U.S. PATENT DOCUMENTS

| | | | | |
|---|---|---|---|---|
| 611,633 A | * | 10/1898 | Horning | 229/116 |
| 1,355,866 A | * | 10/1920 | Stubbs | 229/405 |
| 2,569,733 A | * | 10/1951 | Ringler | 229/120.13 |
| 3,567,105 A | | 3/1971 | McFarlin | |
| 4,126,261 A | | 11/1978 | Cook | |
| 4,714,190 A | | 12/1987 | Morrocco | |
| 4,955,528 A | | 9/1990 | Schluckebier | |
| 5,137,210 A | * | 8/1992 | Hibbs | 229/400 |
| 5,476,215 A | * | 12/1995 | Baroud | 229/902 |
| 5,540,333 A | | 7/1996 | Gonzalez | |
| 5,626,283 A | | 5/1997 | Mellon | |
| 5,630,544 A | | 5/1997 | Shane | |
| 5,720,429 A | | 2/1998 | Cordle | |
| 5,842,631 A | | 12/1998 | Berger | |
| 5,875,957 A | | 3/1999 | Yocum | |
| 6,102,208 A | | 8/2000 | Huang | |
| 6,119,930 A | * | 9/2000 | Lunstra et al. | 229/400 |
| 6,216,946 B1 | * | 4/2001 | Cai | 229/400 |

FOREIGN PATENT DOCUMENTS

| | | | | |
|---|---|---|---|---|
| AU | 642389 B | * | 10/1993 | 229/904 |

* cited by examiner

*Primary Examiner*—Gary E. Elkins
(74) *Attorney, Agent, or Firm*—Dennison, Schultz & Dougherty

(57) ABSTRACT

A collapsible, conical food scoop formed from a unitary blank of flexible material is disclosed which includes a first, food compartment and a second, condiment compartment. The condiment compartment is formed from a panel of material connected between first and second locations on the interior wall of the first compartment, and shifts between a first position overlaying the interior side wall of the food scoop when the scoop is collapsed and a second position spaced apart from the interior side wall for holding a condiment when the scoop is opened for use.

15 Claims, 7 Drawing Sheets

FOOD SCOOP WITH CONDIMENT HOLDER

CROSS REFERENCE TO RELATED APPLICATIONS

This application claims the benefit of the U.S. Provisional Patent Application No. 60/186,212 filed on Mar. 1, 2000, the contents of which are incorporated herein by reference.

TECHNICAL FIELD

The present invention relates generally to a food scoop, and more specifically, to a food scoop with a condiment compartment.

BACKGROUND OF THE INVENTION

Finger foods, such as chicken nuggets, popcorn shrimp, french fries, and onion rings are often served from small paperboard containers. These containers may be pouch-shaped, like those used for french fries in many fast-food establishments, or cup or cone-shaped. Because such containers are often used to scoop individual servings from a product batch, they are sometime referred to as "food scoops."

The food products described above are often dipped into sauces or condiments, such as ketchup, mustard, or vinegar before they are eaten. Many food service establishments provide bulk containers of these condiments and small paper or plastic cups into which they can be dispensed. Alternately, the condiments may come prepackaged in a sealed container.

If the food product is consumed by a person while seated at a table, the condiment containers can be placed on the table. If a person wishes to walk with the container, on a boardwalk or at an amusement park, for example, or to eat the food product while driving a vehicle, the use of a condiment becomes more difficult. Both the condiment cup and food scoop must be held in one hand while the other hand grasps an item of food and dips it in the condiment. This method makes activities such as driving very difficult and possibly dangerous. It is also possible to dispense a condiment directly onto the food products in the food scoop, but this can be messy and often results in an uneven distribution of condiment. When walking or driving, therefore, persons sometimes forgo the use of sauces or condiments altogether, or have to endure the inconvenience of eating sticky, condiment-covered food products with their fingers.

Various attempts have been made to address this problem by providing food containers with compartments for holding condiment. For example, U.S. Pat. No. 5,875,957 to Yocum, owned by the assignee of the present invention, and U.S. Pat. No. 5,720,429 to Cordle show food scoops having interior pockets that can be filled with condiments. However, pockets such as these can be inadvertently squeezed, leading to condiment spills either into the food scoop or onto the user. These pockets also make containers more difficult to assemble and more costly to produce. U.S. Pat. No. 5,417,364 to Shaw and U.S. Pat. No. 5,842,631 to Berger show complex folding shelves formed separately from a food scoop and glued or otherwise attached to the food scoops for supporting a condiment receptacle. Such attachments also add to the cost of food scoops and make them more difficult to assemble. In addition, they do not securely retain a condiment receptacle when the food scoop is carried by a user or balanced in a moving vehicle.

It would therefore be desirable to provide a food scoop with an integrally formed condiment compartment which compartment is capable of securely retaining a condiment even when the food scoop is carried or jarred, and that can be produced at substantially the same cost as existing food scoops that lack this inventive feature.

SUMMARY OF THE INVENTION

The present invention addresses these and other problems by providing a conical food scoop having a compartment for a condiment that extends inwardly from a side wall thereof. The food scoop and compartment are formed from a unitary blank of material. Furthermore, the food scoop can be stored in a flat, collapsed configuration and shifted to an open, use configuration by squeezing two portions of the container together. Preferably, the condiment compartment will open or deploy as the sidewalls of the food scoop are squeezed to form the scoop.

The food scoop and the condiment compartment are formed from a unitary blank of foldable material, such as paperboard. This allows the product to be produced using the same methods used for traditional food scoops.

It is therefore a principal object of the present invention to provide a conical food scoop having a compartment for holding a condiment.

It is another object of the invention to provide a collapsible food scoop having an integral condiment compartment.

It is a further object of the present invention to provide a collapsible food scoop having a condiment compartment that shifts into an open, use position when the food scoop is erected.

It is yet another object of the present invention to provide a collapsible, conical food scoop having a conical condiment compartment.

It is yet a further object of the present invention to provide a blank for forming a conical food scoop having an integral condiment compartment.

BRIEF DESCRIPTION OF DRAWINGS

The present invention will now be described, by way of example, with reference to the accompanying drawings, in which.

DETAILED DESCRIPTION OF THE INVENTION

Figure 2:
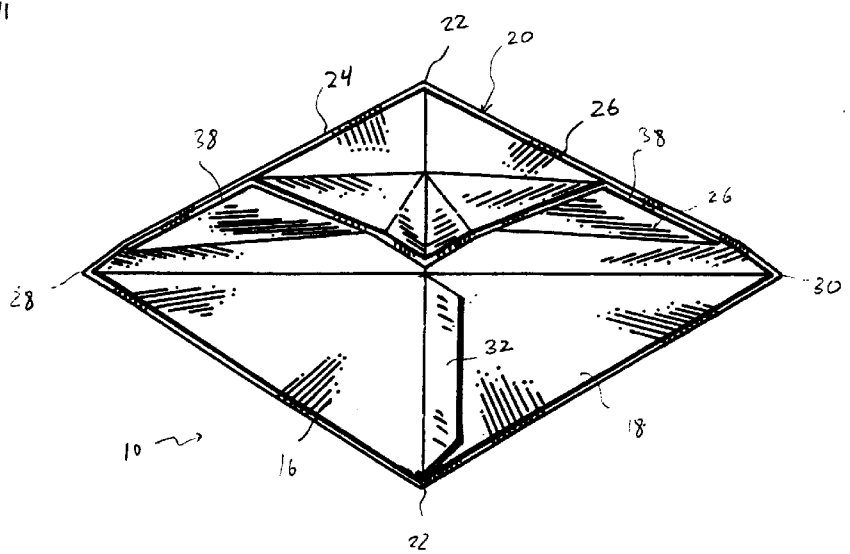
FIG. 2 is a top plan view of the food scoop of FIG. 1.
Figure 1:
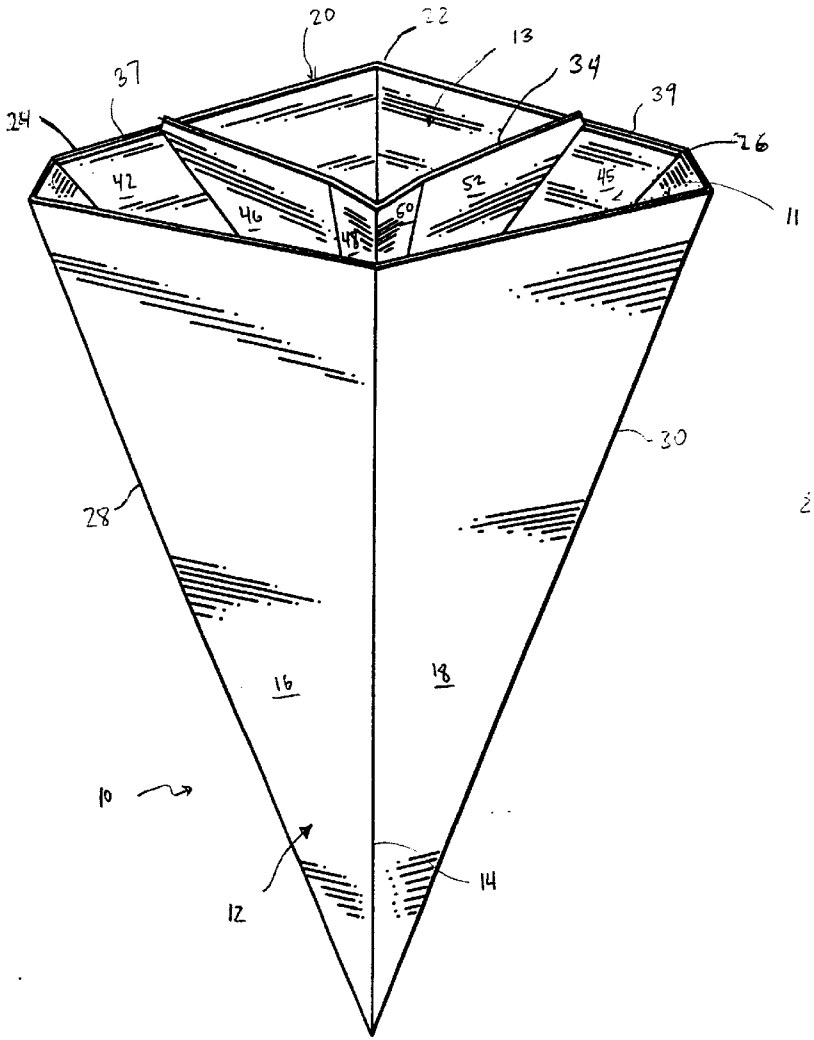
FIG. 1 is a front perspective view of a food scoop according to the present invention.

Referring now to the drawings, wherein the showings are for purposes of illustrating several preferred embodiments of the invention only and not for the purpose of limiting same, FIGS. 1 and 2 show a food scoop designated generally by the numeral 10 having a food compartment 11 and a condiment compartment 13. Food scoop 10 is assembled by folding and gluing a unitary blank 15 which is cut from a sheet of paperboard stock. To facilitate the description of the present invention, the food scoop will be generally described in a position in which it is normally used by a consumer, which is with the opening for the food at the top.

Figure 3:
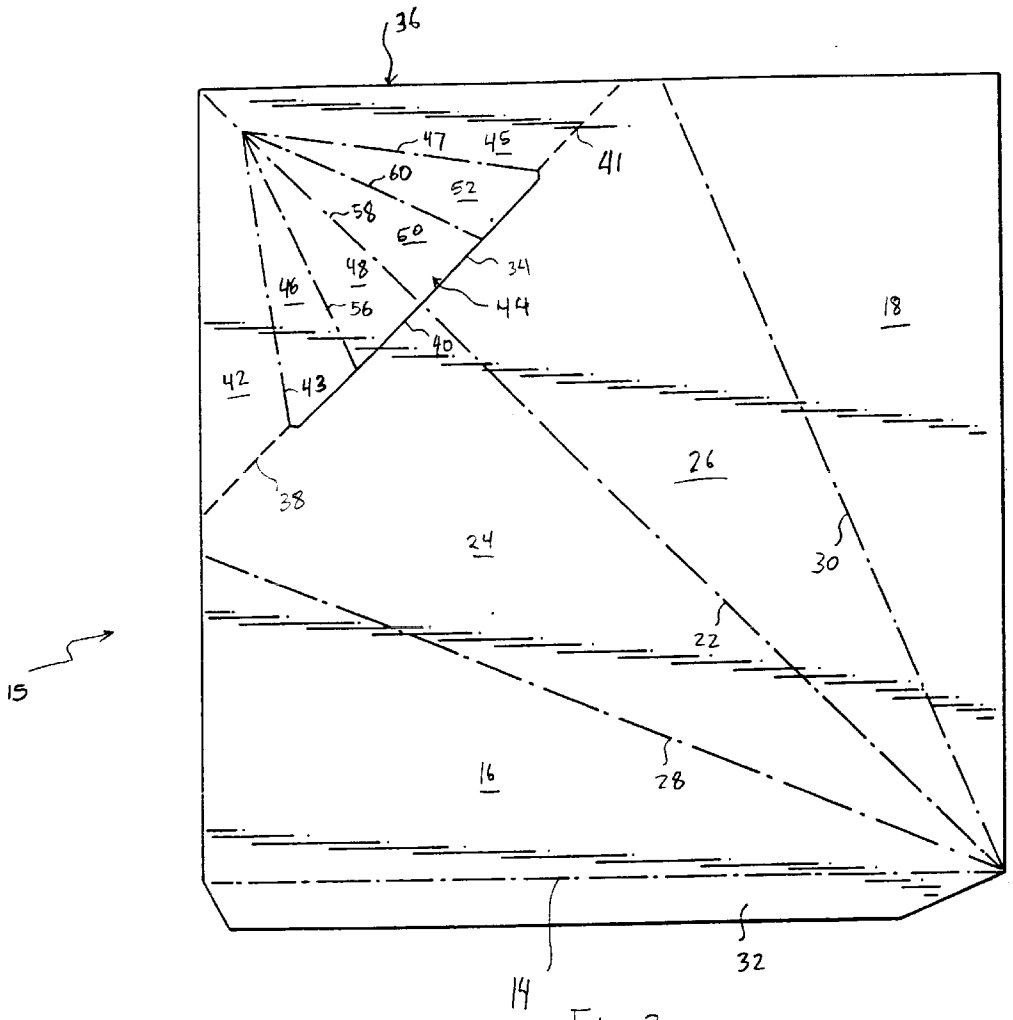
FIG. 3 is a plan view of a blank for forming the food scoop shown in FIG. 1.

Food scoop 10 is assembled by folding the unitary blank shown in FIG. 3 which blank includes a front wall 12 having a first wall portion 16 and a second wall portion 18 attached to first wall portion 16 with a glue flap portion 32 along a vertical first fold line 14. Food scoop 10 further includes a rear wall 20 having a third wall portion 24 and a fourth wall portion 26 divided by a vertical second fold line 22. First wall portion 16 connects to third wall portion 24 along a third fold line 28, and second wall portion 18 connects to fourth wall portion 26 along fourth fold line 30 to form food scoop 10 and define the food and condiment compartments. The wall portions are preferably triangular and form an inverted conical food scoop in the assembled configuration.

Condiment compartment 13, which generally is a receiving area defined between a movable panel and one or more wall portion of the food scoop, extends into the interior of food compartment 11 and generally comprises a triangular panel 36 (shown in FIG. 3) connected to an upper edge 37 of third wall portion 24 along a fifth fold line 38 at one end, and connected to an upper edge 39 of fourth wall portion 26 along a sixth fold line 41 at the other end. A linear slit 40 connects fifth fold line 38 and sixth fold line 41 and allows the condiment holder to open in use as described hereinafter. Although the condiment container deploys automatically at the same time as the food scoop is erected into a use position, an upper edge portion 34 is created adjacent to linear slit 40 because the slit is not collinear with fifth fold line 38 and sixth fold line 41. Upper edge portion 34 extends peripherally beyond upper edges 37 and 39 and provides a finger grip location at which the condiment triangular panel 36 can be gripped and pulled out by a consumer.

Triangular panel 36 includes a first glue flap 42 connected to a central panel 44 along a seventh fold line 43 on one side, and a second glue flap 45 connected to central panel 44 along an eighth fold line 47 at an opposing side. Central panel 44 is further divided into a first sub-panel 46, a second sub-panel 48, a third sub-panel 50, and a fourth sub-panel 52. More specifically, seventh fold line 43 separates first sub-panel 46 from first glue flap 42. A tenth fold line 56 separates first sub-panel 46 from second sub-panel 48. An eleventh fold line 58 separates second sub-panel 48 from third sub-panel 50. A twelfth fold line 60 separates third sub-panel 50 from fourth sub-panel 52, and as stated hereinabove, eighth fold line 47 separates fourth sub-panel 52 from second glue flap 45.

The sub-panels are triangular and the first and second sub-panels 46, 47 overlay the third wall portion when triangular panel 36 is folded along fold lines 38 and 41. Similarly, third and fourth sub-panels 50 and 52 overlay fourth wall portion 26 when the triangular panel is folded. Morever, eleventh fold line 58 is a center fold line which symmetrically divides central panel 44 and, more importantly, overlays second fold line 22 when triangular panel 36 is folded over. As will be explained herein, such configuration allows the condiment compartment to deploy automatically when the food scoop is erected into a use position.

Figure 4:
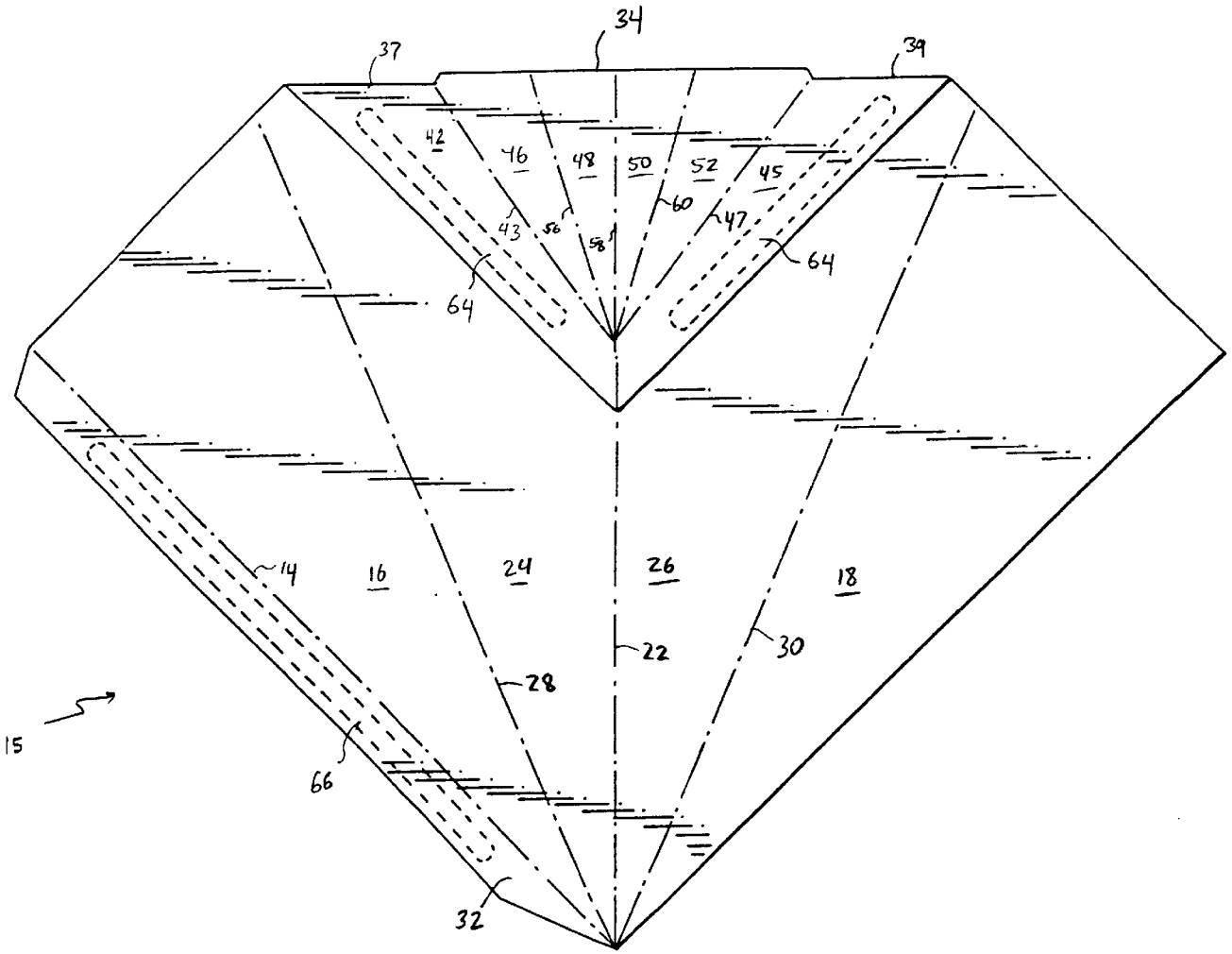
FIG. 4 is a plan view of the blank of FIG. 3 in a partially folded condition.
Figure 5:
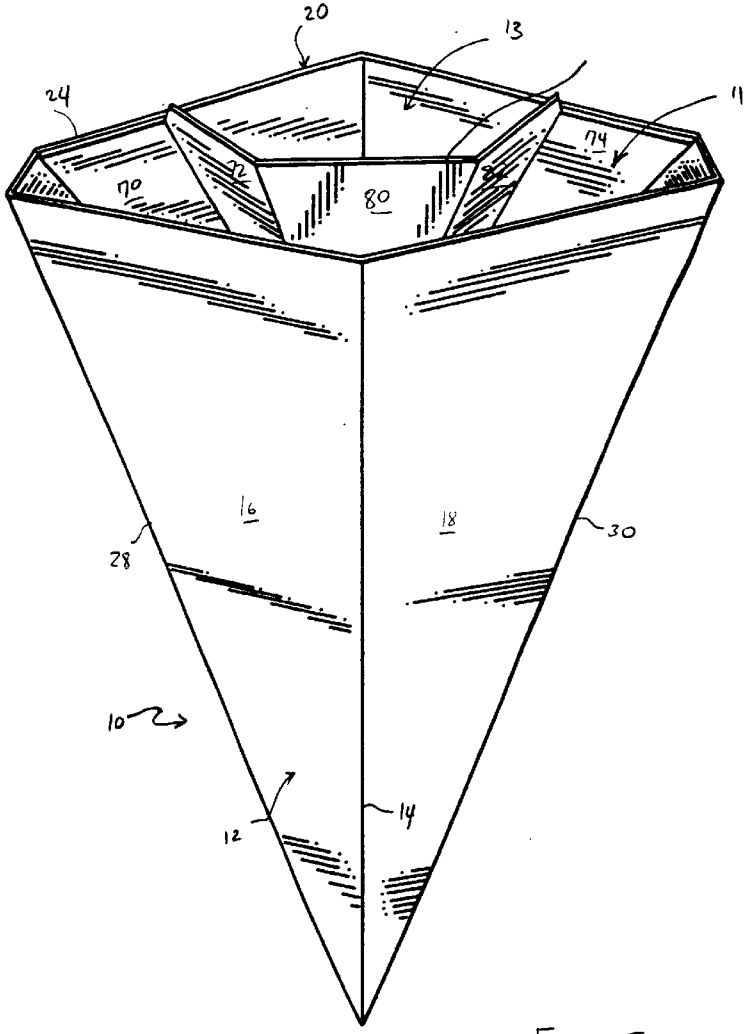
FIG. 5 is a front perspective view of a second embodiment of a food scoop according to the present invention.

The assembly of food scoop 10 will now be explained with particular reference to FIGS. 3 and 4. Triangular panel 36 is folded at fifth fold line 38 and sixth fold line 41 until it overlies third and fourth wall portions 24, 26, as best seen in FIG. 4. Linear slit 40, preferably created during the cutting of unitary blank 15 out of the paperboard stock, leaves upper edge portion 34 peripherally extending out beyond upper edges 37 and 39. Next, adhesive material is applied to glue receiving locations 64 and then first glue flap 42 and second glue flap 45 are adhesively secured to the top surfaces of third wall portion 24 and fourth wall portion 26 respectively and left to dry. Next, first wall portion 16 is folded along third fold line 28 until it overlies third wall portion 24. Then second wall portion 18 is folded along fourth fold line 30 until it overlies fourth wall portion 26 and where the outer edge of second wall portion 18 is aligned with first fold line 14. Therefore, a portion of second wall portion 18 overlies glue flap portion 32. Next, glue flap portion 32 is attached second wall portion by applying adhesive material such as glue a second glue receiving location 66. At this point, food scoop 10 is assembled in non-deployed position used for shipping and storage.

To open food scoop 10 into a use position, the side edges of the food scoop, which correspond to third fold line 28 and fourth fold line 30, are squeezed toward one another to form a cone with a top opening having a square or rhombohedral shape. As the side edges along third and fourth fold lines 28, 30 are squeezed, central panel 44 bows outwardly away from third and fourth wall portions 24, 26 to form the condiment compartment. The compartment can then be filled with a food product which will help to hold the container in an open configuration. When the first compartment is open the second compartment will also be open which allows it to easily be filled with ketchup or other condiment. It should be appreciated that since condiment compartment 13 is located within food scoop 10, if the condiment spills, most will fall into the food compartment and onto the food product rather onto the user. Moreover, the fold lines provide a minimal contact surface area with the consumer's hand, which reduces the amount of heat transferred to a consumer's hand by hot foods such as french fries.

Referring now to FIGS. 5–8, a second embodiment of the invention is illustrated. In this embodiment, elements common to both the first and second embodiments are identified by like numerals. Broadly, the difference between the food scoop in the second embodiment and the food scoop in the first embodiment lies in the number of fold lines formed in central panel 44. More specifically, a triangular panel 136 of the second embodiment includes a third glue flap 70 connected to a central panel 144 along a fourteenth fold line 72 on one side, and a fourth glue flap 74 connected to central panel 144 along a fifteenth fold line 76 at an opposing side. Central panel 144 is further divided into a fifth sub-panel 78, a sixth sub-panel 80, and a seventh sub-panel 82. More specifically, fourteenth fold line 72 separates fifth sub-panel 78 from third glue flap 70. A sixteenth fold line 84 separates fifth sub-panel 78 from sixth sub-panel 80. A seventeenth fold line 86 separates sixth sub-panel 80 from seventh sub-panel 82. Finally, as stated hereinabove, fifteenth fold line 76 separates seventh sub-panel 82 from fourth glue flap 74.

Similar to the first embodiment, the sub-panels of this embodiment are triangular and fifth sub-panel 78 overlies third wall portion 24 and seventh sub-panel 82 overlies fourth wall portion 26 when triangular panel 36 is folded along lines 38 and 41. As stated previously, such configuration will allow the condiment compartment to deploy automatically when the food scoop is erected into a use position.

Figure 6:
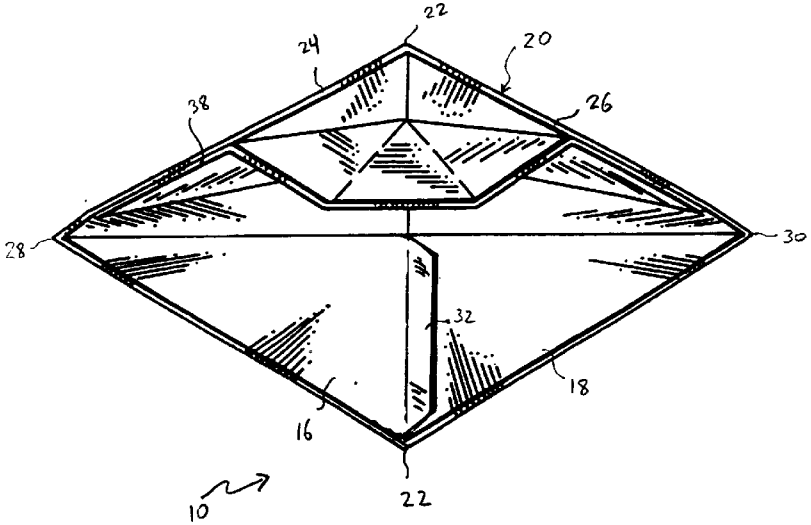
FIG. 6 is a top plan view of the food scoop of FIG. 5.
Figure 7:
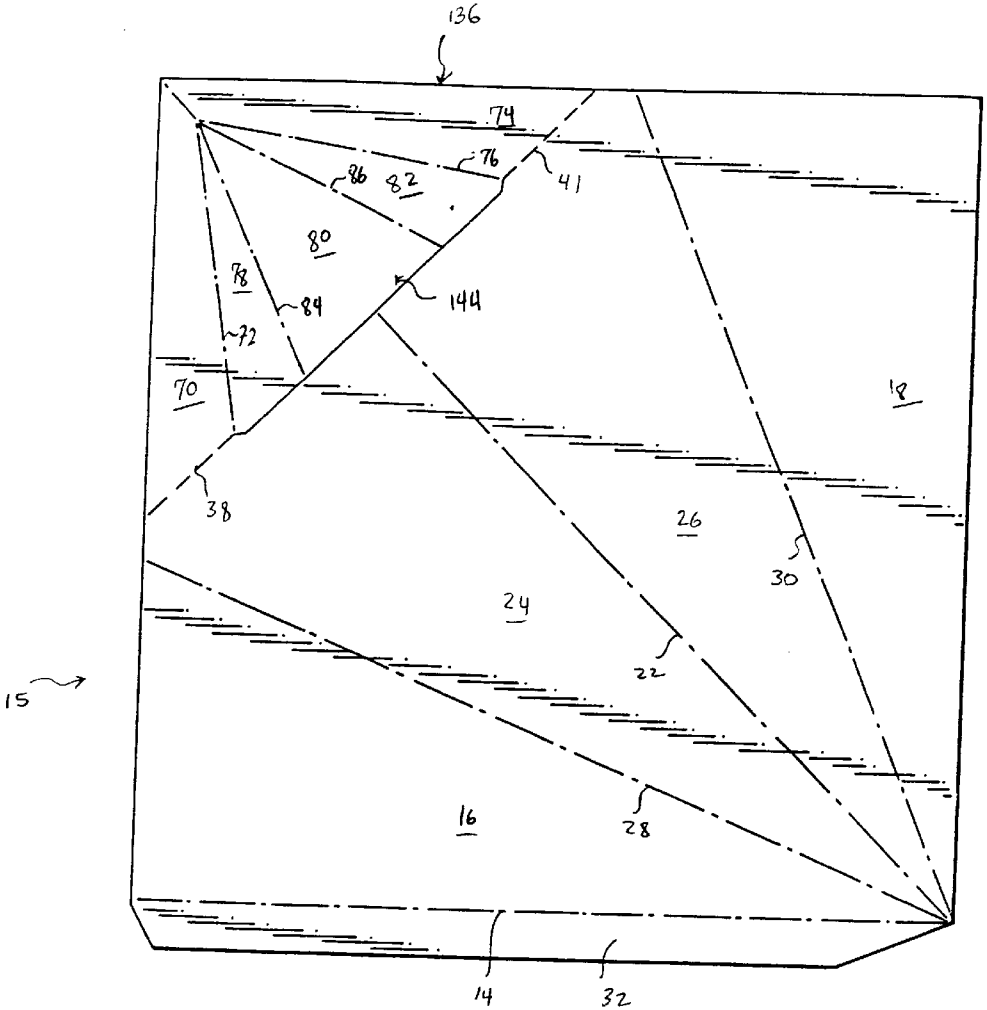
FIG. 7 is a plan view of a blank for forming the food scoop shown in FIG. 5.
Figure 8:
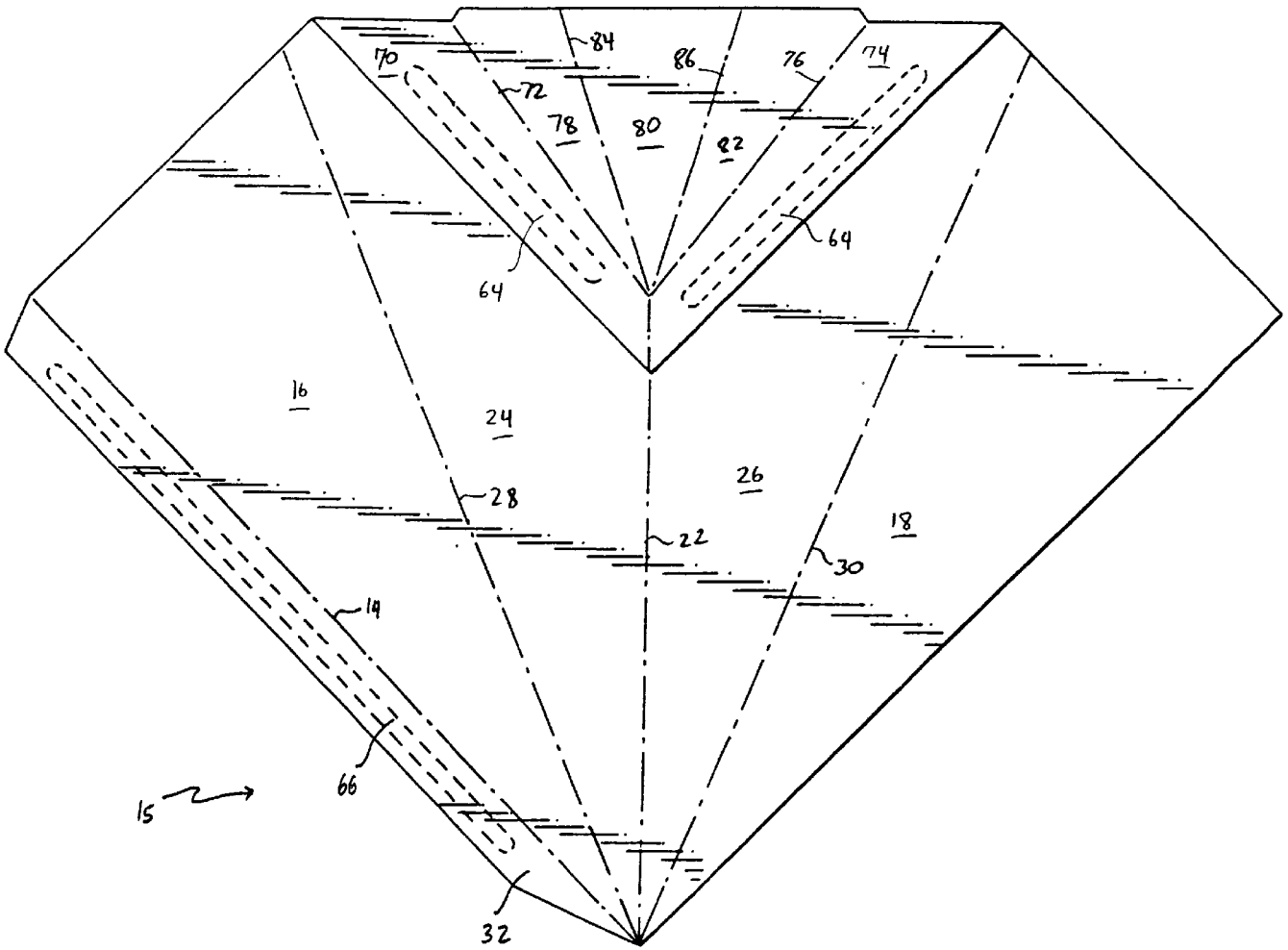
FIG. 8 is a plan view of the blank of FIG. 7 in a partially folded condition; and, FIG. 9 is a plan view of a blank for forming a food scoop according to a third embodiment of the present invention.

The food scoop in the second embodiment is assembled as discussed above in connection with the first embodiment. However, the presence of fewer fold lines in the condiment compartment results in the formation of a compartment having a generally pentagonal top opening as seen in FIG. 6 rather than four sided condiment compartment opening of the first embodiment.

Figure 9:
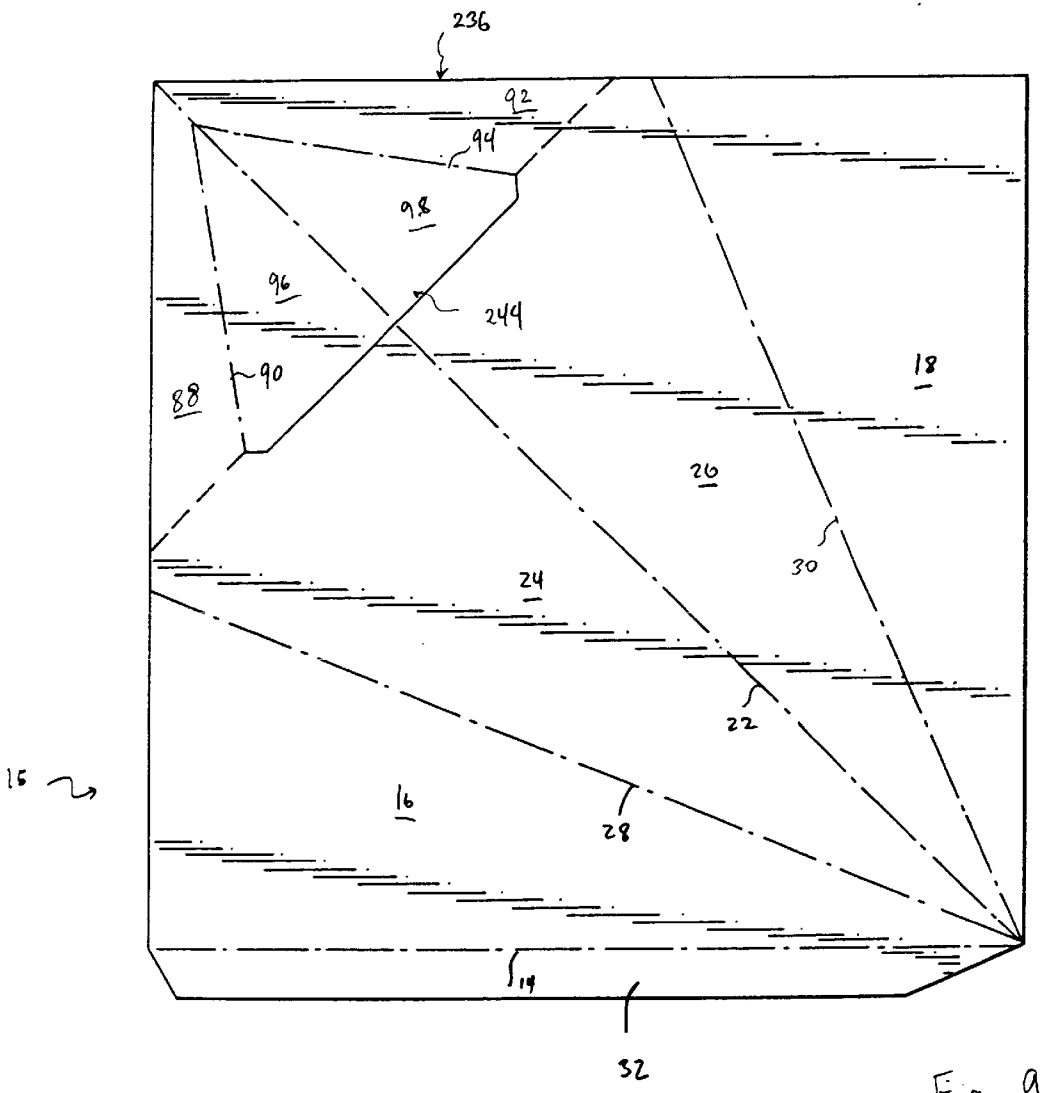

Referring now to FIG. 9, a blank for forming a third embodiment of the food scoop is illustrated. In this embodiment, elements common to both the first and third embodiments are identified by like numerals. Broadly, the difference between the food scoop in the third embodiment and the food scoop of the first embodiment lies in the number of fold lines formed in the central panel. More specifically, triangular panel 236 of the third embodiment includes a fifth glue flap 88 connected to a central panel 244 along an eighteenth fold line 90 on one side, and a sixth glue flap 92 connected to central panel 244 along a nineteenth folding line 94 at an opposing side. Central panel 244 is further divided into an eighth sub-panel 96 connected to a ninth sub-panel 98 along a twentieth fold line 100. It should be noted that twentieth fold line 100 is aligned with and coincides on top of second fold line 22 when triangular panel 236 is folded to overlie third and fourth wall portions 24 and 26.

The subject invention has been describes herein in terms of several preferred embodiments; however, it will be appreciated that additions and modifications to the invention will be come evident to those skilled in the art upon a reading and understanding of the foregoing description together with the attached drawings. For example, the shape of the food scoop used can be varied without departing from the scoop of this invention. It is intended that all such obvious modifications and additions be included within the scope of this application.

I claim:

1. A food scoop, comprising:

a first compartment having first and second side walls defining a scoop interior and having a top edge defining an opening providing access to the interior, said food scoop being shiftable from a first closed configuration to a second open configuration, and, a second compartment, said second compartment comprising at least one panel having a first end attached to said first wall, wherein said first end is integrally connected to said top edge, and a second end attached to said second wall wherein said second end is integrally connected to said top edge, and a central portion, said panel central portion being shiftable from a first location overlaying a portion of said first or second side wall and a second location spaced apart from said first wall;

wherein, shifting said first compartment from said first configuration to said second configuration shifts said panel from said first location to said second location.

2. The food scoop of claim 1 wherein said second compartment is conical.

3. The food scoop of claim 1 wherein said panel further comprises a plurality of sub-panels connected to one another along a plurality of fold lines.

4. The food scoop of claim 1 wherein at least some of said sub-panels are triangular.

5. The food scoop of claim 1 wherein said panel further comprises a first glue flap attached to said first portion of said inner side of said first compartment wall, and a second glue flap attached to said second portion of said inner side of said first compartment wall.

6. The food scoop of claim 1 wherein said first and second sidewalls are triangular and wherein said scoop is shaped like a pyramid.

7. The food scoop of claim 6 further including third and fourth triangular sidewalls connected between said first and second sidewalls.

8. The food scoop of claim 7 wherein said panel comprises first and second end portions attachable to said first and second sidewall and wherein said central portion comprises first and second subpanels.

9. The food scoop of claim 7 wherein said central portion comprises three triangular subpanels.

10. A food scoop, comprising:

first, second, third, and fourth triangular walls interconnected at fold lines and meeting at a bottom vertex, each of said walls having a top edge;

a panel having a first end connected to said first wall, a second end connected to said second wall, wherein said first end is integrally connected to said top edge of said first wall and said second end is integrally connected to said top edge of said second wall, and a central portion comprising first and triangular subpanels;

said food scoop being shiftable between a first, flat configuration wherein said first wall overlays said fourth wall and said panel overlays said first wall, and a second open configuration wherein said first, second, third and fourth walls define a pyramidal space having a top opening formed by the top edges of said first, second, third and fourth triangular walls.

11. A generally square blank for forming a conical food scoop having a condiment compartment comprising:

first, second, third and fourth interconnected triangular panels each having a vertex located at a first corner of said blank;

a fifth triangular panel having a vertex in the corner of the square blank diametrically opposed to said first corner and joined to said second panel at a first fold line and to said third panel at a second fold line;

said fifth triangular panel further including a plurality of triangular subpanels.

12. The blank of claim 11 further including a cut line connecting said first fold line and said second fold line.

13. The blank of claim 12 wherein said first fold line and said second fold line are collinear and wherein said cut line has a central portion parallel to said first fold line.

14. The blank of claim 11 wherein said triangular subpanels are spaced apart from the edge of said square blank.

15. The blank of claim 13 wherein said fifth triangular panel comprises first and second peripheral subpanels and a central subpanel having a vertex and a plurality of fold lines radiating from said vertex to said cut line.

* * * * *